United States Patent [19]

Litta

[11] Patent Number: 4,562,826

[45] Date of Patent: Jan. 7, 1986

[54] HEAT EXCHANGER FOR FIREPLACES WITH ZIG-ZAG PATH OF THE FLAMES

[76] Inventor: Angelo Litta, Via Calzolese, 33, 00030 S. Cesareo (Province of Rome), Italy

[21] Appl. No.: 619,327

[22] Filed: Jun. 11, 1984

[30] Foreign Application Priority Data

Apr. 11, 1984 [IT] Italy ..... 48024 A/84

[51] Int. Cl.[4] ..... F24B 9/04

[52] U.S. Cl. ..... 126/132

[58] Field of Search ..... 126/132, 130, 121, 131, 126/129

[56] References Cited

U.S. PATENT DOCUMENTS 1,432,538 10/1922 De Armond ..... 126/132
2,170,729 8/1939 Perry ..... 126/132

FOREIGN PATENT DOCUMENTS 2926277 1/1981 Fed. Rep. of Germany ..... 126/132
2483576 12/1981 France ..... 126/132

*Primary Examiner*—William E. Lyddane
*Assistant Examiner*—Gerald Anderson
*Attorney, Agent, or Firm*—Holman & Stern

[57] ABSTRACT

A heat exchanger for a fireplace comprises a tubular grate, a double-walled rectangular, vertical, flat panel located at the back of the fireplace at right angles with the grate tubes, two flat double-walled vertical side panels set at about 45 degrees with respect to the centerline of the fireplace, a zig-zag double-walled panel which extends upwards from the upper side of the back panel to nearly reach the inner surface of the fireplace hood and a double-walled counter panel with angled profile which is so positioned with respect to the zig-zag panel that a progressively narrower throat is formed therebetween for the flames and smoke which rise from the hearth. Due to such tortuous passage of decreasing cross-section for the fire, flame and smoke, the overall height of the exchanger can be reduced so that it can be readily removed from the fireplace masonry structure.

3 Claims, 4 Drawing Figures

HEAT EXCHANGER FOR FIREPLACES WITH ZIG-ZAG PATH OF THE FLAMES

BACKGROUND OF THE INVENTION

1. Field of the Invention

The present invention relates to a heat exchanger to be fitted into conventional open domestic fireplaces for more efficient use of the heat from burning wood or coal by heating a fluid, such as water, to be circulated through a hot water heating system.

2. Description of the Prior Art

Boilers to be fitted into domestic fireplaces for heating a certain amount of water by wood or coal combustion, are well known.

Multi-tube panels by which the hearth area is surrounded are usually employed along with smaller vessels located within the fireplace hood for totally exploiting the combustion products and thereby increasing the thermal efficiency of the fireplace which otherwise would by rather low.

The structure of such exchangers becomes thus complicated and cumbersome and the fitting of the exchanger into the fireplace, its maintenance, and cleaning become difficult and time consuming. However, up to now, very little importance has been attached to the problem of designing heat exchangers for being fitted into existing fireplaces without modifying the fireplace masonry and, in general, the esthetic aspect of the fireplaces already existent particularly in buildings of architectural importance and heat exchangers adapted for being readily removed from the fireplace when this is to be restored to its original state and function.

BRIEF SUMMARY OF THE INVENTION

The present invention obviates such drawbacks by means of a boiler made up of double walled panels and a tubular grate connected thereto. Thus a compact structure results which can be readily installed into a fireplace and removed therefrom.

The leading features of the exchanger of this invention are as follows:

a. a wide heat exchange interface between the combustion products and fluid to be circulated through the domestic heating system;

b. a tortuous path of the combustion products which is defined by the reciprocal position of the double walled panels through which the fluid is circulated;

c. a heat exchanger readily removable from the fireplace for cleaning and for using the fireplace in the conventional way.

In order to achieve the aforementioned objects, the heat exchanger for a fireplace of this invention comprises the following main components:

1. a tubular grate made up of parallel tubes at right angles to the fireplace opening the front ends of which are connected to a transverse header or manifold;

2. a double-walled flat vertical panel disposed at the back of the fireplace perpendicular to the grate tubes;

3. two double-walled flat vertical panels diverging at an angle of about 45 degrees to the back panel and consequently to the median plane of the fireplace. The purpose of the divergence is for preventing as far as possible the ambient air from passing between the panels and the fireplace side walls which air, when flowing over the outer surfaces of said panels would subtract heat therefrom and dissipate it through the flue. Furthermore, such divergent panels will aid in preserving the conventional aspect of old fireplaces wherein the side walls of the fireplace recess are usually divergent towards the opening thereof;

4. a special double-walled zig-zag panel extending from the upper edge of the back panel to nearly reach the inner surface of the fireplace hood which zig-zag panel is integrated by a double-walled counter panel with angled profile which is so disposed relatively to said zig-zag panel that a progressively narrower throat for the combustion products rising from the hearth is formed therebetween.

By such artifice the object is achieved of creating a tortuous passage of decreasing passage cross-section for the flame and smoke whereby the overall height of the exchanger is reduced and the fitting and removing thereof into and out of the fireplace are made casier.

BRIEF DESCRIPTION OF THE DRAWINGS

The present invention will now be described in greater detail with reference to the accompanying drawings wherein.

DETAILED DESCRIPTION

With reference to the drawings the heat exchanger of this invention comprises a tubular grate 2 made up of tubes which extend from the fireplace opening to nearly reach the back wall of the same where they connect with a double-walled vertical panel 4 at the lower edge thereof.

Figure 1:
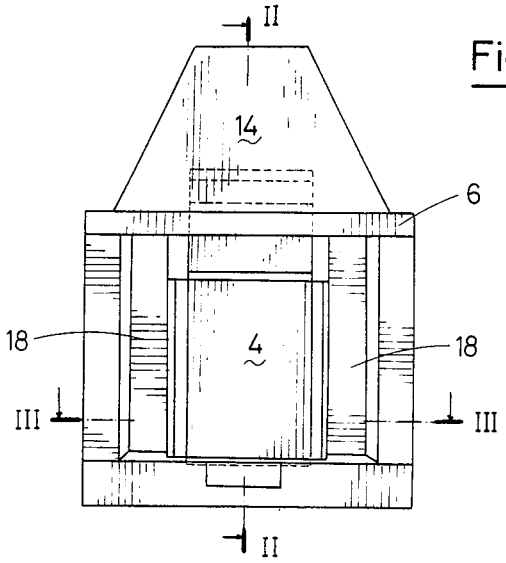
FIG. 1 is a front elevational view of a fireplace equipped with the heat exchanger of this invention.
Figure 3:
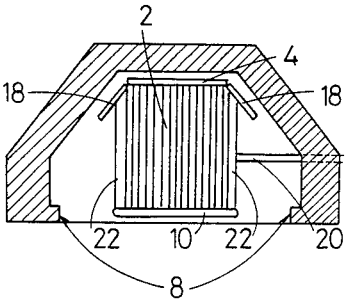
FIG. 3 shows a schematic horizontal cross-sectional view FIG. 1 taken along line III—III of FIG. 1.
Figure 2:
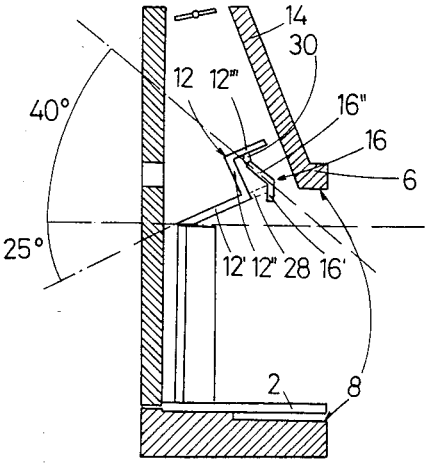
FIG. 2 is a schematic vertical centerline cross-sectional view taken along line II—II of FIG. 1.
Figure 4:
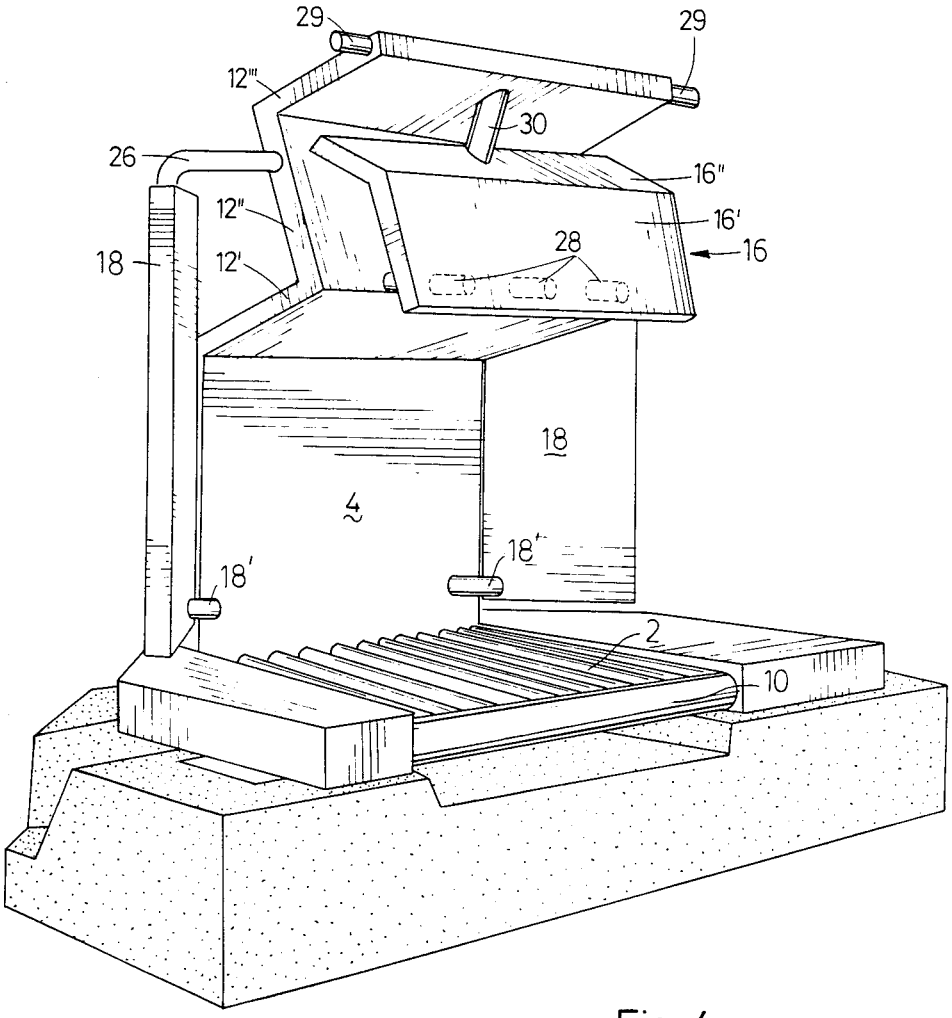
FIG. 4 is a perspective view of the heat exchanger for a fireplace shown in FIG. 1.

The grate tubes at their ends opposite to panel 4 connect with a transverse header or manifold 10 of larger diameter from each end of which a branch 22 extends alongside the grate 2 and connects to the lower edge of back panel 4 through a choking connector the purpose of which is for ensuring a regular flow through the tubes of grate 2 the same as through said branches 22. Panel 4 extends from the plane of grate 2 to nearly reach the level of the fireplace mantel 6. The upper edge of panel 4 communicates along its total length with the lower edge, of the same length, of a double-walled zig-zag panel made up of three flat sections of which a first one 12' projects towards the fireplace hood 14 at an angle of about 25 degrees to the horizontal. Section 12' communicates along its upper edge with the lower edge of the second section 12'' disposed at right angles to section 12' and the upper edge of panel section 12'' communicates with the third panel section 12''' at right angles to second section 12'' and extending towards the fireplace hood. The inner spaces within panel 4 and within sections 12', 12'', 12''' of panel 12 form a unitary space or cavity of uniform thickness. The extent of section 12' as measured on the median plane of the fireplace that is on the plane of FIG. 2 is about twice those of section 12'' and 12'''.

In front of panel 12 a counter panel 16 is positioned which is made up of two sections one of which 16' lies on a substantially vertical plane and the other of which 16'' forms an inner angle of about 130 degrees with section 16'. Thus, as already mentioned a tortuous passage is provided between panels 12 and 16, the width of which decreases upwardly in as much as the distance between the lower edge of section 16' and the corner at the joining of sections 12' and 12'' is about three times the distance between the upper edge of section 16'' and the wall of section 12'''.

The zig-zagging path of the flame between panels 12 and 16 allows making the exchanger lower whereby it can be fitted into a lower fireplace and readily removed therefrom.

At each side of panel 4 a double-walled vertical panel 18 is provided whose height is about one and a half times the height of panel 4 and which is set at an angle of about 45 degrees thereto. The width of side panel 18 is about one half that of panel 4.

THE FLUID (MAINLY WATER) CIRCULATION THROUGH THE HEAT EXCHANGER.

The fluid is fed to the exchanger through a pipe 20 which leads into one of the tubular branches 22 of header 10 from which it flows into panel 4, through tubular grate 2, and through the choking connectors inserted between branches 22 of header 10 and panel 4. From the upper edge of panel 4 the fluid flows into zig-zag panel 12 and reaches the upper section 12''' wherefrom it flows into the hot-water system through two connectors 29 at the sides of the same edge.

The fluid circulation through counter panel 16 is ensured by three inlet stub pipes 28 each of which connects at one end thereof with panel 12 at the outer corner between sections 12' and 12'' and at its other end with panel 16 at the inner corner between sections 16' and 16'' and by an outlet stub pipe 30 which connects the upper edge of panel 16 with section 12''' at the center thereof. Pipes 28 and 30 in addition to integrating the fluid system function also as mechanical connections of panel 16 to panel 12.

Each panel 18 is connected to back panel 4 by means of an elbow pipe 18' of which one end is fastened to the lower corner of panel 4 and the other end is fastened to panel 18 at the lower corner thereof adjacent to panel 4 and is connected to panel 12 by means of an angled pipe 26 of which a length extends vertically upwards from the upper edge of panel 18 and a further length extends horizontally to reach the lateral edge of panel 12''.

I claim:

1. Heat exchanger for a fireplace having a front opening, rear wall, side walls, and hood above the opening having an inner wall leading to the flue, comprising:

a substantially horizontal grate comprised of a plurality of parallel tubes extending from a position adjacent the front opening of the fireplace to a position adjacent the rear wall of the fireplace;

a front tubular header extending transversely to said parallel tubes adjacent the front of the opening and operatively connected to the front ends of said tubes to allow intercommunicating fluid flow therebetween;

a tubular branch header on each side of said grate extending parallel to said grate tubes and connected to said front header;

a double walled vertical back panel adapted to fit against the rear wall of the fireplace and operatively connected to the rear ends of said grate tubes adjacent the lower edge thereof to allow intercommunicating fluid flow therebetween, said back panel having a height of about three-quarters the height of the fireplace opening;

a Z-shaped double walled panel having the same width as said back panel comprised of a lower planar section inclined upwardly from said back panel toward the fireplace opening at substantially 25° with respect to horizontal and communicating along its lower edge with the upper edge of said back panel, a middle planar section extending substantially perpendicular to said lower section toward the rear of the fireplace, and an upper section extending substantially perpendicular to said middle section toward the inner wall of the hood;

an inverted substantially V-shaped counter panel in spaced relationship with the front of said middle section comprised of a lower planar section and an upper planar section at substantially 130° with respect to each other, said upper section of said counter panel being inclined upwardly toward said Z-shaped panel to form a throat between said Z and V-shaped panels having a progressively narrower cross-section upwardly for the flow of combustion products rising from the fireplace hearth;

a vertical double walled side panel on each side of the heat exchanger extending from a position adjacent each side edge of said back panel toward the fireplace opening in symmetrical diverging relationship with respect to the back panel so that the diverging angle formed by said side panels is bisected by the front to rear vertical median plane of the fireplace and having a height approximately one and one-half times the height of said back panel; and means to connect the inner space of each of said side panels with the inner space of each of said back panel and Z-shaped panel, and the inner space of said Z-shaped panel to the inner space of said counter panel for fluid flow therethrough.

2. A heat exchanger as claimed in claim 1 wherein:

said means to connect the inner space of each side panel to said back panel comprises an elbow pipe at the lower adjacent corners of said side and back panels;

said means to connect each side panel to said Z-shaped panel comprises an angled pipe having a length extending vertically upwardly from the upper edge of a respective side panel and a length extending horizontally from said vertical length to the respective side edge of said Z-shaped panel.

3. A heat exchanger as claimed in claim 2 wherein:

said diverging angle between said side panels is approximately 90°.

* * * * *